United States Patent [19]

Rius

[11] 4,181,985

[45] Jan. 8, 1980

[54] SANITARY SPRAY ATTACHMENT FOR TOILET BOWL

[76] Inventor: Roberto R. Rius, 2220 Barrington Ct., South San Francisco, Calif. 94080

[21] Appl. No.: 887,972

[22] Filed: Mar. 20, 1978

[51] Int. Cl.[2] ..... E03D 9/08

[52] U.S. Cl. ..... 4/7

[58] Field of Search ..... 4/7, 6, 182, 341

[56] References Cited

U.S. PATENT DOCUMENTS

| | | | |
|---|---|---|---|
| 2,605,477 | 8/1952 | Monserrat | 4/7 |
| 3,845,509 | 11/1974 | Lieber | 4/7 |
| 4,041,553 | 8/1977 | Sussman | 4/7 |

*Primary Examiner*—Lenard A. Footland

*Attorney, Agent, or Firm*—Howard I. Podell

[57] ABSTRACT

A spray attachment for connection to a conduit supplying water to a toilet bowl having a seat spaced above the bowl which includes a first valve controlling flow to the bowl and to a second valve from which extends a flexible tube passing under the toilet seat and having an upturned nozzle at its outward end centrally of the bowl. In a modification, the nozzle is connected to the tube by a swivel joint to bring the nozzle into and out of operating position in the toilet bowl.

1 Claim, 2 Drawing Figures

SANITARY SPRAY ATTACHMENT FOR TOILET BOWL

FIELD OF THE INVENTION

This invention relates generally to a toilet bowl attachment for directing a spray of water against the user's lower excretory surfaces.

DESCRIPTION OF THE PRIOR ART

The prior art, as exemplified by U.S. Pat. Nos. 3,845,509; 3,605,124; 3,781,919; 2,605,477 or 2,504,257 is generally illustrative of the pertinent art but the aforementioned patents are non-applicable to the present invention. While the prior art expedients are generally acceptable for their intended purposes only, they have not proven entirely satisfactory in that they are either complex and expensive to manufacture, or bulky and inconvenient to use. As a result of the shortcomings of the prior art, typified by the above, there has developed a substantial need for improvement in this field.

The principal object of this invention is to provide a device of this character which combines simplicity, strength and durability in a high degree, together with inexpensiveness of construction so as to encourage widespread use thereof.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

SUMMARY OF THE INVENTION

This invention resides in a spray attachment for connection to a conduit supplying water to a toilet bowl having a seat spaced above the bowl which includes a first valve controlling flow to the bowl and to a second valve from which extends a flexible tube passing under the toilet seat and having an upturned nozzle at its outward end centrally of the bowl. In a modification, the nozzle is connected to the tube by a swivel joint to bring the nozzle into and out of operating position in the toilet bowl.

BRIEF DESCRIPTION OF THE DRAWING

In the accompanying drawing, in which is shown one of the various possible illustrative embodiments of this invention, wherein like reference character identify the same or like parts.

DESCRIPTION OF THE PREFERRED EMBODIMENTS

Figure 1:
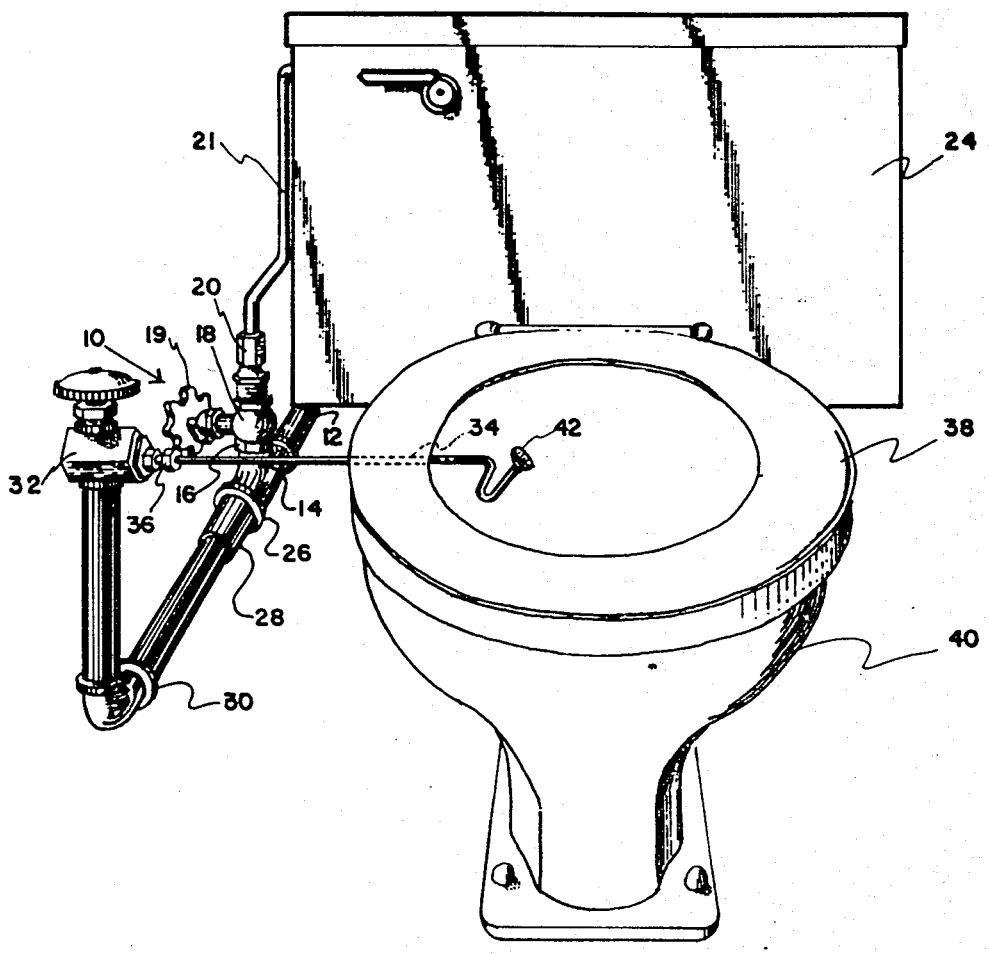
FIG. 1 is a view in perspective of a toilet bowl fitted with the attachment of this invention.

With reference to the drawing, there is shown and illustrated a sanitary spray attachment for toilet bowls constructed in accordance with the principles of the invention and designated generally by reference character 10. The illustrated tangible embodiment of the invention includes a $1\frac{1}{2}$ inch long galvanized iron pipe 12 connected to a source of supply of water and to a T-shaped connector 14. On top of the connector 14 is threaded a half-close nipple 16 secured to $\frac{1}{2}$ inch shut-off valve 18. Fitted with $\frac{1}{2}\times\frac{3}{8}$ inch compression brass fitting 20 and handle 19 a twelve inch flexible tube 21 connects fitting 20 to the tank 22 supplying water to the toilet bowl 24. If a problem occurs with the tank 22, the user can shut-off the valve 18 by turning its handle 19.

A $\frac{1}{2}$ inch close nipple 26 is threaded onto the outward end of connector 14. A $\frac{1}{2}\times\frac{3}{8}$ inch reducer 28 is secured to nipple 26. An upwardly bent elbow tube 30 connects reducer 28 to a $\frac{3}{8}\times\frac{3}{8}$ angle stop valve 32. A flexible copper tube 34 has its inward end mounted on packing nut 36 at the outlet of valve 32, as shown in FIG. 1, tube 34 passes under seat 38. Its outward end is then bent upwardly and substantially centrally of bowl 40. Nozzle or sprayer head 42 is mounted on the end of tube 34 for directing a jet of water upwardly as controlled by handle 44 of valve 32.

Figure 2:
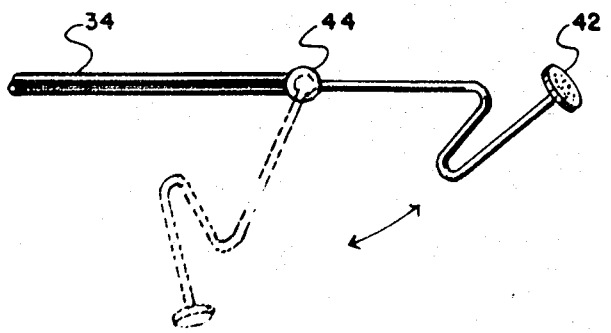
FIG. 2 is a top plan view of a modification showing in dashed lines the sprayer head in inoperative position.

FIG. 2 shows a modification of the invention wherein tube 34 is made shorter than in the just described embodiment and is connected to head 42 by swivel joint 44. When desired, the head can be pivoted to inoperative position against one side of bowl 40.

Among the advantages of the invention is a saving of toilet paper by eighty to ninety percent. It also facilitates the cleaning of small children. It is valuable for thoroughly cleaning the anus of hemorrhoid sufferers and serves as a bidet for the vulvo-vaginal areas.

The operation and use of the invention hereinabove described will be evident to those skilled in the art to which it relates from a consideration of the foregoing.

The present invention is believed to accomplish among others all of the objects and advantages herein set forth.

Without further analysis, the foregoing will so fully reveal the gist of this invention that those skilled in the art can by applying current knowledge thereto readily adapt it for various applications without omitting certain features which can constitute essential characteristics of the generic or specific aspects of this invention. Therefore, a more lengthy description is deemed unnecessary.

It is intended that various changes may be made in this invention in the practical development thereof, if desired. Such changes are comprehended within the meaning and range of equivalency of the following claims. The invention, therefore, is not to be restricted except as is necessitated by the prior art.

Having thus described the invention, what is claimed as new and to be secured by Letters Patent is:

1. A spray attachment for connection to a conduit supplying water to the tank of a toilet bowl having a seat spaced above the bowl, comprising a first valve connected to said conduit and controlling flow to said tank; a second valve receiving water from said conduit; a flexible tube having a portion passing between the upper part of said bowl and said seat and receiving water from said second valve; said flexible tube having an upwardly directed nozzle mounted on the outward end thereof substantially in the center of said bowl, in an operating position of the device, including a swivel joint pivotally attaching said nozzle to said flexible tubing for moving said nozzle into and out of said operating position, said swivel joint located and oriented such that the nozzle may be pivoted against an inner side of the said bowl when the nozzle is moved out of the said operating position.

* * * * *